US010350744B2

(12) United States Patent
Lopano et al.

(10) Patent No.: US 10,350,744 B2
(45) **Date of Patent: *Jul. 16, 2019**

(54) ERGONOMIC HANDLE FOR POWER TOOL

(75) Inventors: Daniel N. Lopano, Bel Air, MD (US); Gabriel N. Concari, Eldersburg, MD (US); Sion N. Netzler, Abingdon, MD (US); Dustin Lee, Baltimore, MD (US)

(73) Assignee: BLACK & DECKER INC., New Britain, CT (US)

( * ) Notice: Subject to any disclaimer, the term of this patent is extended or adjusted under 35 U.S.C. 154(b) by 2061 days.

This patent is subject to a terminal disclaimer.

(21) Appl. No.: 13/570,676

(22) Filed: Aug. 9, 2012

(65) Prior Publication Data

US 2013/0032010 A1 Feb. 7, 2013

Related U.S. Application Data

(63) Continuation of application No. 12/707,038, filed on Feb. 17, 2010, now Pat. No. 8,267,192.

(60) Provisional application No. 61/208,399, filed on Feb. 24, 2009.

(51) Int. Cl.
*B25F 5/02* (2006.01)

(52) U.S. Cl.
CPC ..... *B25F 5/02* (2013.01)

(58) Field of Classification Search
CPC ..... B25F 5/02; Y10T 16/476; Y10T 16/44
USPC ..... 16/430; 81/489; D8/303, 68
See application file for complete search history.

(56) References Cited

U.S. PATENT DOCUMENTS

| | | | |
|---|---|---|---|
| 3,019,673 | A | 2/1962 | Sjostrand et al. |
| 3,488,825 | A | 1/1970 | Lundgren |
| 4,330,093 | A | 5/1982 | Chapman, Jr. |
| D295,714 | S | 5/1988 | Sasaki et al. |
| D298,509 | S | 11/1988 | Brosius et al. |
| 4,858,811 | A | 8/1989 | Brosius et al. |
| D314,320 | S | 2/1991 | Brosius et al. |
| D323,276 | S | 1/1992 | Fushiya et al. |

(Continued)

FOREIGN PATENT DOCUMENTS

| | | |
|---|---|---|
| DE | 92 09 725.1 | 7/1992 |
| DE | 201 02 675 U1 | 5/2001 |

(Continued)

OTHER PUBLICATIONS

Drawings and photographs of power tools existing before the filing date of the present application; online: http://www.hitachi-koki.co.jp/powertools/products/drill/wh14dbl/wh14dbl.html; printed Jan. 10, 2008.

(Continued)

*Primary Examiner* — Andrew M Tecco
(74) *Attorney, Agent, or Firm* — Scott B. Markow

(57) ABSTRACT

An ergonomic handle for use with a power tool defines a first region that includes a switch, adapted to receive a thumb and forefinger when the forefinger is actuating the switch, a second region adapted to receive a middle finger, a third region adapted to receive a ring finger; and a fourth region adapted to receive a pinky finger. Each of the second, third, and fourth region includes a generally oval cross section having a major axis and a minor axis. The longest major axis is in the third region, the shortest major axis is in the fourth region, the shortest minor axis is in the second region, and the longest minor axis is positioned in the fourth region.

19 Claims, 15 Drawing Sheets

(56) References Cited

U.S. PATENT DOCUMENTS

| | | | | |
|---|---|---|---|---|
| D329,580 | S | 9/1992 | Sasaki et al. | |
| D340,393 | S | 10/1993 | Okumura | |
| 5,353,474 | A * | 10/1994 | Good et al. | 16/421 |
| D380,952 | S | 7/1997 | Kim | |
| D388,678 | S | 1/1998 | Bantly et al. | |
| D393,580 | S | 4/1998 | Bantly et al. | |
| D393,581 | S | 4/1998 | McCallops et al. | |
| D395,387 | S | 6/1998 | Snider | |
| 5,778,989 | A | 7/1998 | Neumaier | |
| 5,829,099 | A * | 11/1998 | Kopelman et al. | 16/430 |
| D413,242 | S | 8/1999 | Robson | |
| 5,979,015 | A * | 11/1999 | Tamaribuchi | 16/110.1 |
| 6,161,256 | A | 12/2000 | Quiring et al. | |
| D440,850 | S | 4/2001 | Ozawa et al. | |
| 6,308,378 | B1 * | 10/2001 | Mooty et al. | 16/430 |
| 6,392,381 | B1 | 5/2002 | Chen | |
| D458,103 | S | 6/2002 | Chen | |
| D458,824 | S | 6/2002 | Chen | |
| D459,177 | S | 6/2002 | Chen | |
| D467,483 | S * | 12/2002 | Heun | D8/68 |
| D472,781 | S | 4/2003 | Netzler | |
| D475,596 | S | 6/2003 | Ozawa et al. | |
| D477,205 | S | 7/2003 | Sakai et al. | |
| 6,615,930 | B2 | 9/2003 | Bongers-Ambrosius et al. | |
| D484,385 | S | 12/2003 | Sakai et al. | |
| 6,729,415 | B1 | 5/2004 | Huang | |
| D496,843 | S | 10/2004 | Sugawara et al. | |
| 6,799,643 | B2 | 10/2004 | Voulkidis et al. | |
| D499,945 | S | 12/2004 | Sugawara et al. | |
| D500,653 | S | 1/2005 | Concari | |
| 6,840,335 | B1 | 1/2005 | Wu | |
| D504,604 | S * | 5/2005 | Leasure et al. | D8/68 |
| 6,905,052 | B2 | 6/2005 | Sakai et al. | |
| D508,642 | S | 8/2005 | Kokawa et al. | |
| D508,836 | S | 8/2005 | Schiller et al. | |
| D509,119 | S | 9/2005 | Schiller et al. | |
| 6,988,295 | B2 * | 1/2006 | Tillim | 16/430 |
| D519,808 | S | 5/2006 | Otsuka et al. | |
| D520,832 | S * | 5/2006 | Ozawa et al. | D8/68 |
| D520,834 | S | 5/2006 | Furuta et al. | |
| D524,136 | S | 7/2006 | Taniguchi et al. | |
| D525,099 | S | 7/2006 | Nagasaka et al. | |
| D525,505 | S | 7/2006 | Ito et al. | |
| D525,848 | S | 8/2006 | Kokawa | |
| D527,237 | S | 8/2006 | Otsuka et al. | |
| D527,971 | S | 9/2006 | Kokawa | |
| D528,888 | S | 9/2006 | Nagasaka et al. | |
| 7,108,079 | B2 | 9/2006 | Sakai et al. | |
| D531,476 | S | 11/2006 | Kokawa et al. | |
| 7,134,510 | B2 | 11/2006 | Justis et al. | |
| 7,140,451 | B2 | 11/2006 | Yoshimizu et al. | |
| D533,422 | S | 12/2006 | Ino et al. | |
| D533,423 | S | 12/2006 | Ino et al. | |
| D536,943 | S * | 2/2007 | Tsai et al. | D8/68 |
| D539,110 | S | 3/2007 | Okuda | |
| 7,185,998 | B2 | 3/2007 | Oomori et al. | |
| D540,639 | S | 4/2007 | Watson | |
| D540,640 | S | 4/2007 | Clay | |
| D543,081 | S * | 5/2007 | Watson | D8/68 |
| D545,159 | S | 6/2007 | Schoen et al. | |
| D546,154 | S * | 7/2007 | Fong et al. | D8/68 |
| D551,047 | S * | 9/2007 | Lopano | D8/68 |
| D556,002 | S | 11/2007 | Ino | |
| 7,325,627 | B2 | 2/2008 | Tanji | |
| 7,506,409 | B2 * | 3/2009 | Tillim | 16/430 |
| 8,267,192 | B2 * | 9/2012 | Lopano et al. | 173/170 |
| 2001/0011884 | A1 | 8/2001 | Sakakibara | |
| 2002/0100347 | A1 | 8/2002 | Daubinger et al. | |
| 2003/0074766 | A1 * | 4/2003 | Tillim | 16/430 |
| 2003/0159843 | A1 | 8/2003 | Sakai et al. | |
| 2004/0029426 | A1 | 2/2004 | Lui et al. | |
| 2004/0106036 | A1 | 6/2004 | Geis et al. | |
| 2005/0121209 | A1 | 6/2005 | Shimizu et al. | |
| 2005/0257944 | A1 * | 11/2005 | Cooper | 173/217 |
| 2005/0269884 | A1 | 12/2005 | Teranishi et al. | |
| 2006/0048959 | A1 | 3/2006 | Sakai et al. | |
| 2006/0060366 | A1 | 3/2006 | Bodine et al. | |
| 2006/0075605 | A1 | 4/2006 | Lagaly et al. | |
| 2006/0102367 | A1 | 5/2006 | Etter et al. | |
| 2006/0143866 | A1 | 7/2006 | Lagaly et al. | |
| 2006/0175069 | A1 * | 8/2006 | Sakakibara et al. | 173/217 |
| 2006/0243469 | A1 | 11/2006 | Webster | |
| 2007/0277987 | A1 | 12/2007 | Meyer et al. | |

FOREIGN PATENT DOCUMENTS

| | | |
|---|---|---|
| DE | 203 15 329 U1 | 3/2004 |
| EP | 0 142 650 A2 | 9/1984 |
| EP | 0 142 650 | 5/1985 |
| EP | 0 142 650 A2 | 5/1985 |
| EP | 0 261 260 | 3/1988 |
| EP | 1 690 649 | 8/2006 |
| GB | 2 169 541 | 7/1986 |
| GB | 2 392 002 A | 2/2004 |
| JP | A 01-501207 | 4/1989 |
| JP | U 02-056580 | 4/1990 |
| JP | A 11-221781 | 8/1991 |
| JP | 6-70564 | 10/1994 |
| JP | 09-002550 | 1/1997 |
| JP | 9239672 | 9/1997 |
| JP | A 09-295285 | 11/1997 |
| JP | 10044054 | 2/1998 |
| JP | 10-086078 | 4/1998 |
| JP | A 11-221781 | 8/1999 |
| JP | 2000070777 | 3/2000 |
| JP | D1108845 | 3/2001 |
| JP | A 2001-162565 | 6/2001 |
| JP | 2001-198856 | 7/2001 |
| JP | A 2001-198856 | 7/2001 |
| JP | A 2001-211559 | 8/2001 |
| JP | A 200-273667 | 9/2002 |
| JP | A 2002-254341 | 9/2002 |
| JP | A 2002-337074 | 11/2002 |
| JP | 2003-039346 | 2/2003 |
| JP | 2003211374 | 7/2003 |
| JP | A 2003-209960 | 7/2003 |
| JP | D1187794 | 8/2003 |
| JP | 2003-245876 | 9/2003 |
| JP | 2003-290689 | 10/2003 |
| JP | D1201916 | 2/2004 |
| JP | 2004-174670 | 6/2004 |
| JP | 2004-174671 | 6/2004 |
| JP | D1123614 | 8/2004 |
| JP | 2004-261906 | 9/2004 |
| JP | 2004249422 | 9/2004 |
| JP | 2005-035286 | 2/2005 |
| JP | 2005-199406 | 7/2005 |
| JP | 2005297119 | 10/2005 |
| JP | 2006-000948 | 1/2006 |
| JP | 2006-116626 | 5/2006 |
| JP | 2006-123086 | 5/2006 |
| JP | 2007-307626 | 11/2007 |
| WO | WO 88/02242 | 4/1988 |
| WO | WO 88/02242 A1 | 4/1988 |

OTHER PUBLICATIONS

Drawings and photographs of power tools existing before the filing date of the present application; Powerpoint presentation.

Drawing and photograph of power tools existing before the filing date of the present application; Panasonic Power Tool—online: http://www2.panasonic.com/consumer-electronics/shop/Building-Products/Cordless-Tools/Drill-Drivers/model.EY7440LN2S_11002_7000000000000005702; printed Feb. 7, 2008.

Search Report for European application No. 1 690 649 dated May 17, 2006.

Hitachi Cordless Driver Drill DB10DL, Handling instructions, http://www.hitachi-koki.com/manual_view_export/pdf_manual_view.do?implementationWorkNumber=710&partsCode=C99167821

(56) References Cited

OTHER PUBLICATIONS

&model=DB10DL&marketSeq=5, online, cover page, pp. 1 and 48, printed Apr. 1, 2009.

* cited by examiner

ERGONOMIC HANDLE FOR POWER TOOL

RELATED APPLICATIONS

This application claims is a continuation of U.S. patent application Ser. No. 12/707,038, filed Feb. 17, 2010, titled "Ergonomic Handle for Power Tool," which in turn claims priority under 35 U.S.C. § 119(e) to U.S. Provisional Patent Application No. 61/208,399, filed Feb. 24, 2009, titled "Ergonomic Handle for Power Tool." Each of the foregoing applications is incorporated by reference.

TECHNICAL FIELD

This application relates to an ergonomic handle for a power tool, such as a drill or impact driver.

BACKGROUND

Power tools, such as electric drills or impact drivers, generally have a housing, a tool holder coupled to the housing, a handle that extends from the housing, and a power source (e.g., a battery or an AC cord) that is coupled to the handle away from the housing. However, many power tool handles are configured in a manner that may cause significant fatigue or stress in the user when the power tool is used for an extended period of time.

SUMMARY

In one implementation, an ergonomic handle for a power tool is configured to reduce user fatigue and/or stress during periods of extended use. The power tool has a housing that contains a source of motion (e.g., a motor). The source of rotary motion is coupled directly or indirectly (e.g., by a transmission such as a planetary gear train or beveled gear train) to a working end of the tool that is coupled to a first end portion of the housing. The working end includes an output shaft or spindle that defines an output axis. The power tool also includes a handle with a proximal end portion coupled to the housing and a distal end portion coupled to a power source (e.g., a battery. an AC cord, or a source of compressed air). The handle extends generally along a handle axis that is at an angle to the output axis. In one implementation, the angle may be such that the distal end portion is located rearward of the proximal end portion. In another implementation, the battery may define an axis that is substantially parallel to the handle axis.

From the proximal end to the distal end, the handle defines a first, second, third, and fourth region. The first region includes a trigger for actuating the source of rotary motion, and is adapted to receive the user's thumb, and the user's forefinger when the forefinger is actuating the trigger. The second region is adapted to receive the user's middle finger when the trigger is being actuated. The third region is adapted to receive the user's ring finger when the trigger is being actuated. The fourth region is adapted to receive the user's pinky finger when the trigger is being actuated. It should be understood that the positions of the user's fingers on the first through fourth regions are rough approximations and may vary from user to user. It should also be understood that the user's fingers may be positioned differently when the trigger is not being actuated.

In another implementation, an ergonomic handle is disclosed for use with a power tool, the power tool having a power source, a housing containing a source of motion, and a tool holder coupled the housing and defining a tool holder axis and a forward direction toward a working end of the tool and rearward direction away from the working end of the tool. The handle includes a handle portion having a proximal end coupled to the housing and a distal end coupleable to the power source, and defining, from the proximal end to the distal end, a first region, a second region, a third region, and a fourth region, and defining a handle axis that is generally transverse to the tool holder axis. The first region includes a switch for actuating the source of motion and adapted to receive a user's thumb and forefinger when the forefinger is actuating the switch. The second region is adapted to receive the user's middle finger, the third region is adapted to receive the user's ring finger; and the fourth region adapted to receive the user's pinky finger. Each of the second region, the third region, and the fourth region includes a generally oval cross section having a major axis and a minor axis. The cross section having the longest major axis is positioned in the third region, the cross section having the shortest major axis is positioned in the fourth region, the cross section having the shortest minor axis is positioned in the second region, and the cross section having the longest minor axis is positioned in the fourth region.

In another implementation, the distal end defines a rearward-most point on the handle, the rearward-most point being located at or more further rearward than any point on any portion of the second, third, and fourth regions. A rearward edge of the second, third, and fourth regions is shaped like a top-half of a parenthesis. A proximal end of the second region defines a forward-most point on the second, third, and fourth regions of the handle, the forward-most point located at or more forward than any other point on the second, third, and fourth regions. A forward edge of the second, third, and fourth regions has a shape like a bottom half of a parenthesis, with a slight curvature in the forward direction at a distal end of the bottom half of the parenthesis.

In another implementation, the first portion has a thumb-forefinger recess on a rearward portion of the first portion. The thumb-forefinger recess has a curvature configured to receive a web between the user's thumb and forefinger. An imaginary line drawn between a center point of a radius of the thumb-forefinger recess and a center-point of the switch is substantially parallel to the tool holder axis.

In another implementation, the first portion includes a thumb-knuckle recess configured to receive the thumb knuckle of the user. When viewed in a cross-section taken generally transverse to the tool holder axis, the thumb-knuckle recess has a curvature opposite to the curvature of the remainder of the handle.

In another implementation, a rearward portion of the fourth region includes a palm grip relief that is configured to receive hypothenar muscles of the palm. When viewed in a cross-section substantially parallel to the tool holder axis, the handle portion has a first generally elliptical shape and the palm grip relief surface has a second, different shape. The first generally elliptical shape has a first minor axis centered on a central plane of the handle portion, and the second shape is a second elliptical shape having a minor axis that is not centered on the central plane. The minor axis of the second elliptical shape is larger than the minor axis of the first elliptical shape.

In another implementation, the handle portion includes a finger support ridge that runs along a side of the handle, the finger support ridge starting adjacent to the switch in the first region and extending in a rearward direction substantially parallel to the tool holder axis. The finger support ridge further extends through the second and third regions substantially parallel to the handle axis. The finger support ridge further extends through the fourth section in a curved section that extends forward and then rearward as it extends distally.

In other implementations, the housing may be substantially transverse to the handle axis (e.g., a piston-grip drill, a hammer drill or an impact driver) or the housing may be substantially parallel to the handle axis (e.g., a right-angle drill).

The handle may be implemented with any one or more of the above implementations. Advantages may include one or more of the following. The handle is contoured to the anatomy of a user's hand. This increases the comfort of the user when using the power tool and reduces user fatigue. This also reduces the occurrence of discomfort when using the tool handle. Other advantages and features will be apparent from the description and the drawings.

DETAILED DESCRIPTION

Figure 1:
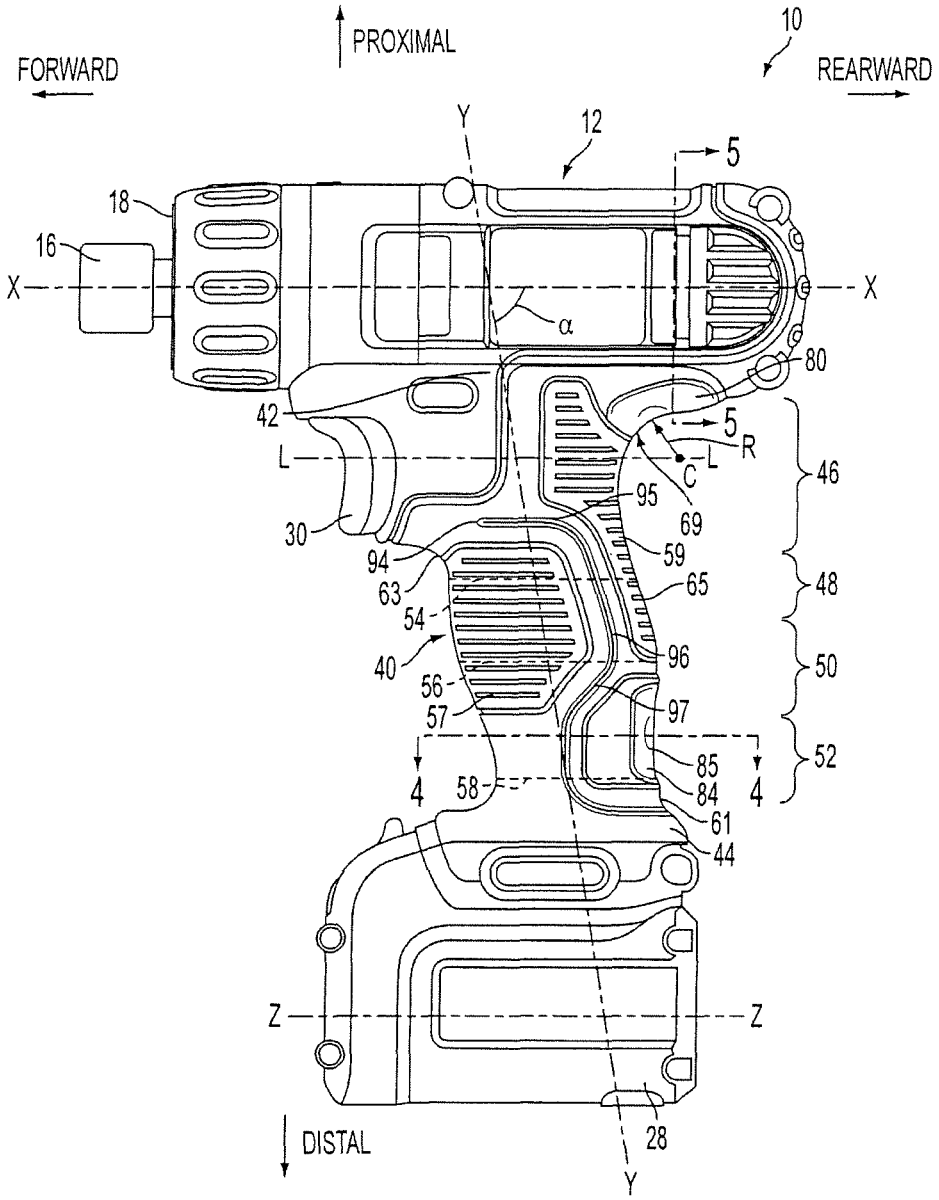
FIG. 1 is a side view of a first embodiment of a power tool having an ergonomic handle.
Figure 9:
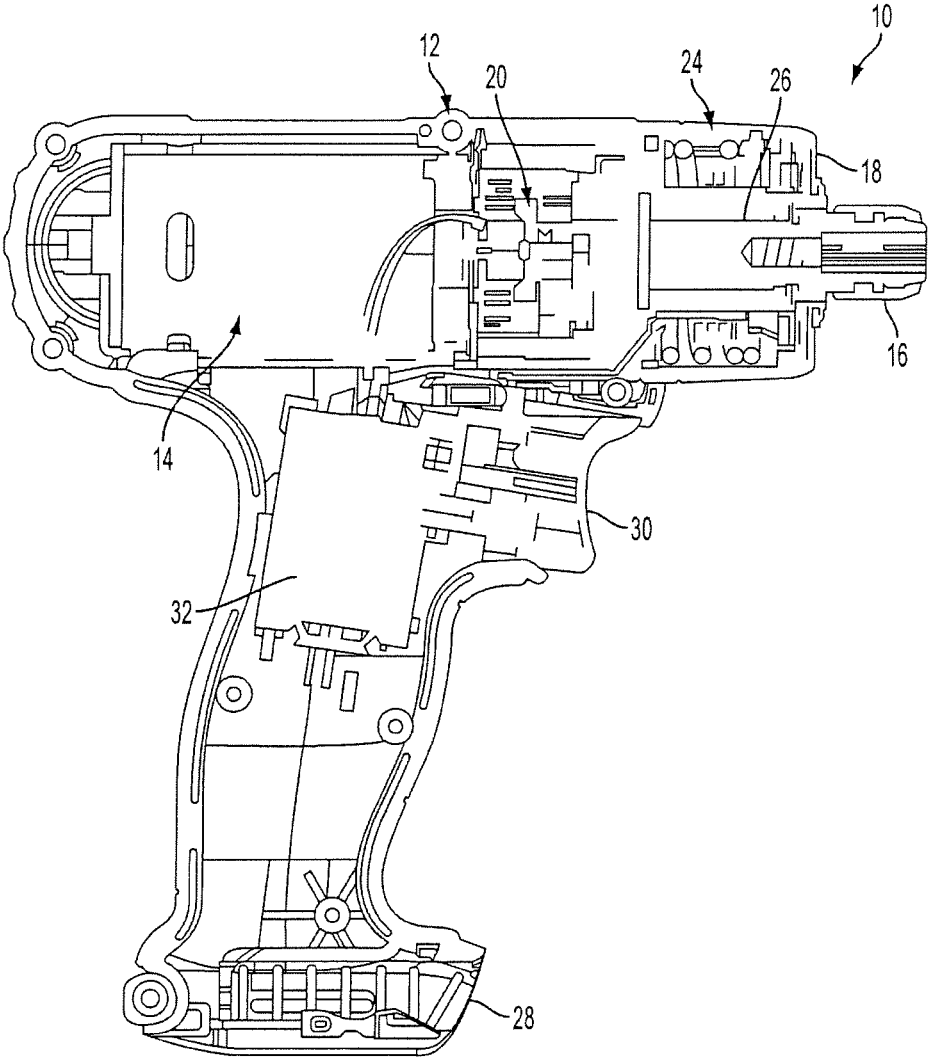
FIG. 9 is a cross-sectional side view of the power tool of FIG. 1, showing interior components of the tool.

Referring to FIGS. 1 and 9, a first embodiment of a power tool 10 has a housing 12 that contains a source of motion, in the form of a rotary motor 14. Coupled to a front end 18 of the housing is a working end of the tool in the form of a tool holder 16 for retaining a tool bit (e.g., a drill bit or screw driving bit, not shown) defining a tool holder axis X-X. As shown, the working end is a hex bit retention mechanism. Further details regarding an exemplary tool bit holder are set forth in commonly-owned U.S. patent application Ser. No. 12/394,426, which is incorporated herein by reference. The working end could also be another element, such as a different hex but retainer, a chuck, or a nosepiece of a nailer or stapler. The motor 14 drives the tool holder 16 in a rotary motion via a transmission gears 20, a clutch 24, and an output spindle 26. The motor is powered by a power source in the form of a battery 28, which is coupled to the motor via a trigger 30 that actuates a switch 32 for selectively activating the motor 14. The battery 28 defines an axis Z-Z that is substantially parallel to the tool bit holder axis X-X. As shown in the drawings, the power tool is a battery powered cordless drill. However, it should be understood that the tool may be any type of corded, cordless, pneumatic, or combustion powered tool, such as a screwdriver, an impact driver or wrench, a hammer, a hammer drill, a nailer, a stapler, a saw, a grinder, a sander, a router, a flashlight.

The power tool 10 also includes a handle 40 with a proximal end portion 42 coupled to the housing 12 and a distal end portion 44 coupled to the battery 28. The handle extends generally along a handle axis Y-Y that is at an angle $\alpha$ to the tool bit holder axis X-X. For example, the angle $\alpha$ may be approximately 80 degrees, such that the distal end portion is located generally rearward of the proximal end portion, although it should be understood that this angle can be varied among a wide range of angles.

Figure 7:
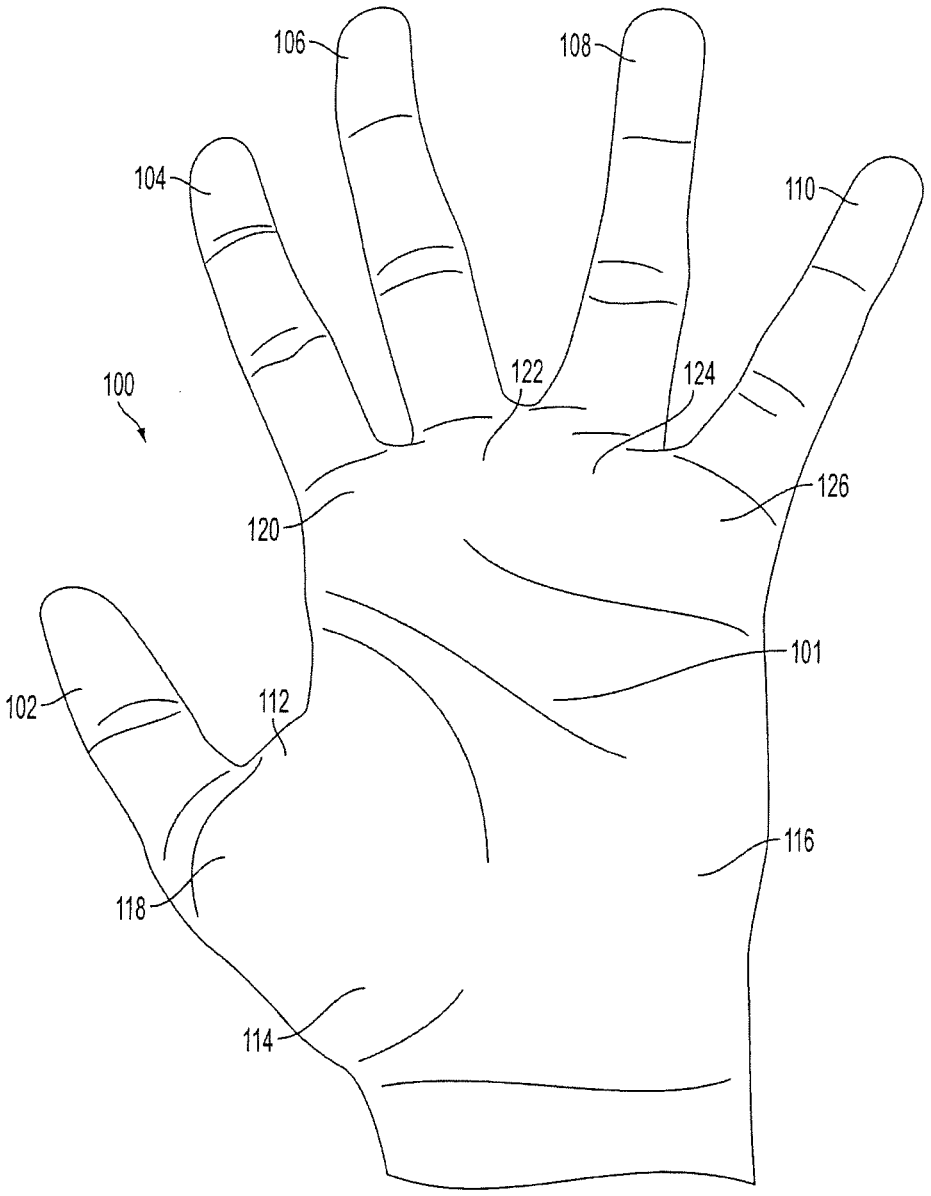
FIG. 7 is an external view of a human hand from the palm side.
Figure 8:
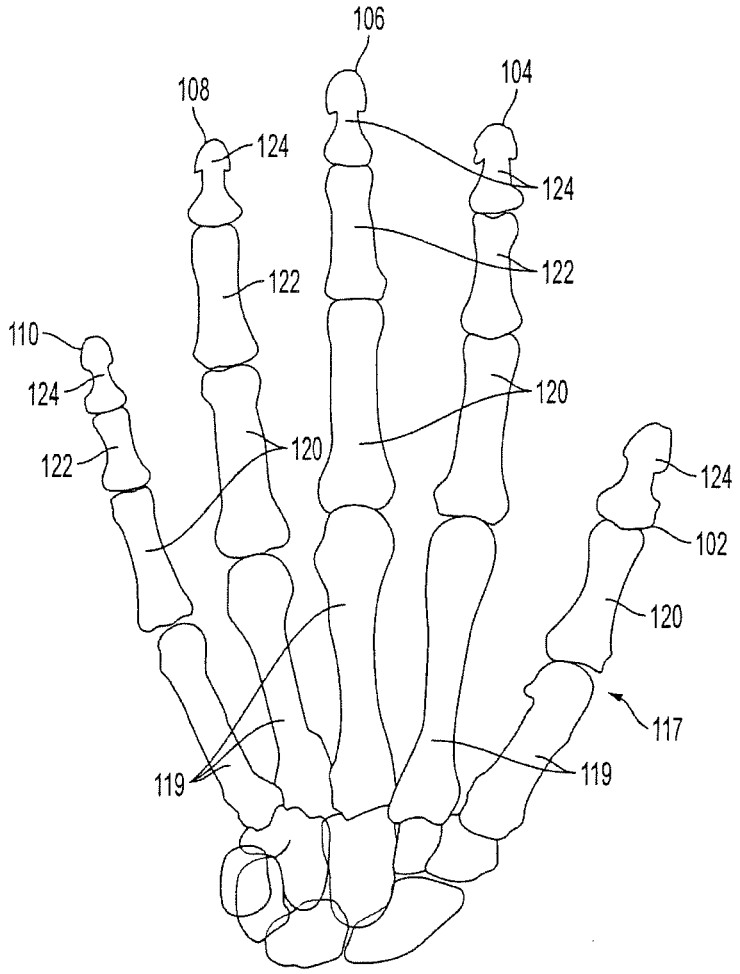
FIG. 8 is a schematic view of the bones of a human hand.

The handle 40 is ergonomically designed to be contoured to a user's hand, the anatomy of which is shown in FIGS. 7 and 8. Generally, a user's hand 100 includes a palm 101 to which is connected a thumb 102, a forefinger 104, a middle finger 106, a ring finger 108, and a pinky finger 110. The palm 101 is formed by five metacarpals 119. Each finger is formed by a proximal phalange 120 coupled to a metacarpal 119, an intermediate phalange 122, and a distal phalange 124. The thumb is formed by a proximal phalange 120 coupled to a metacarpal 119, and a distal phalange 124 coupled to the proximal phalange 120. There are knuckles at the joints between these bones. A web 112 of muscles connects the base of the thumb 102 and forefinger 104. In addition, the palm includes two fleshy pads in the form of the thenar eminence 114 on the thumb side of the palm and the hypothenar eminence 116 on the pinky side of the palm. Further, there are fleshy pads 118, 120, 122, 124, and 126 on the palm side at the base of the thumb and each finger.

Figure 6:
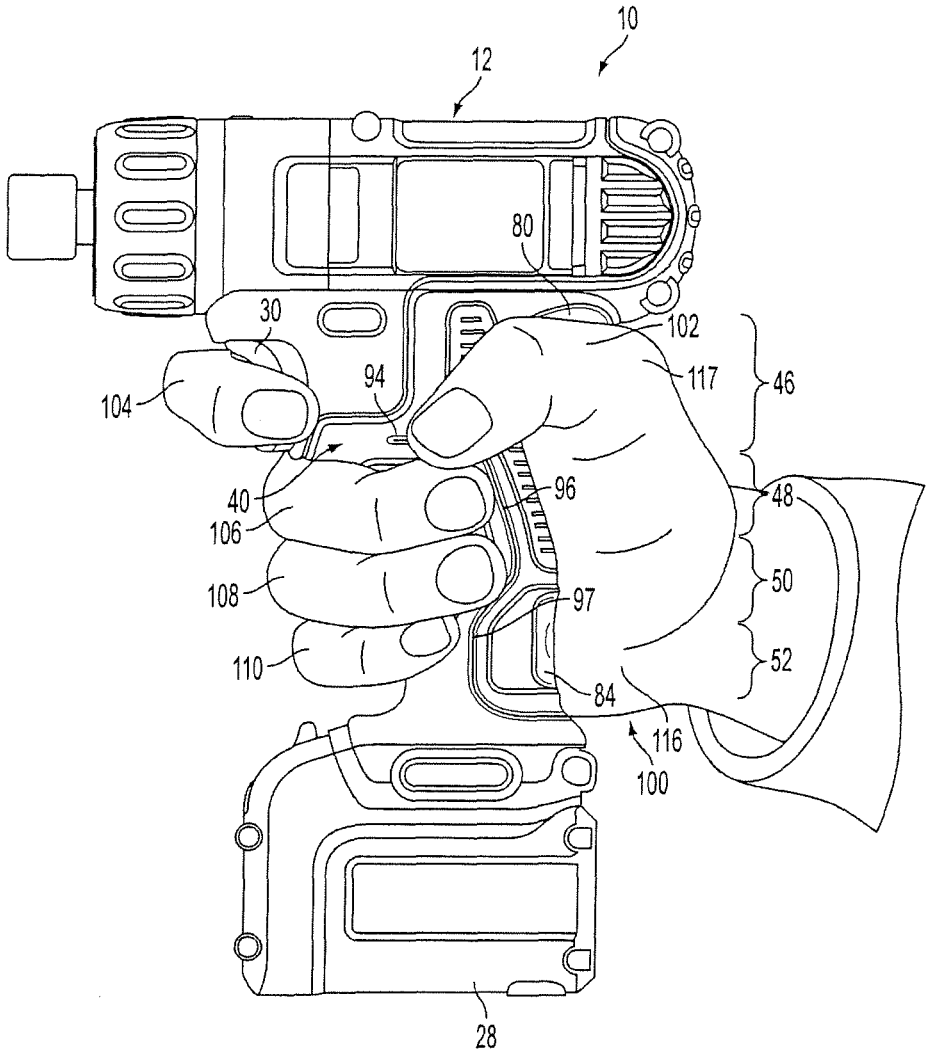
FIG. 6 is a side view of a power tool of FIG. 1 being held in a hand of a user.

Referring to FIGS. 1 and 6, from the proximal end portion 42 to the distal end portion 44, the handle 40 defines a first region 46, a second region 48, third region 50, and fourth region 52, which is adapted to receive the user's hand as follows, while the trigger is being actuated. The first region 46 includes the trigger 30, and is adapted to receive the user's thumb 102 and forefinger 104, while the forefinger 104 actuates the trigger. The second region 48 is adapted to receive the user's middle finger 106. The third region 50 is adapted to receive the user's ring finger 108. The fourth region 52 is adapted to receive the user's pinky finger 110. It should be understood that the positions of the user's fingers on the first through fourth regions are rough approximations and may vary from user to user. It should also be understood that the user's fingers may be positioned differently when the trigger is not being actuated. For example. the forefinger, middle finger, ring finger, and pinky finger may all be received together on the second, third, and fourth regions, with the thumb received on the first region. In one embodiment, the overall length of the second, third, and fourth regions is at least approximately 64 mm, as it has been found that at least this length is needed to receive the hands of a majority of users.

Figure 3:
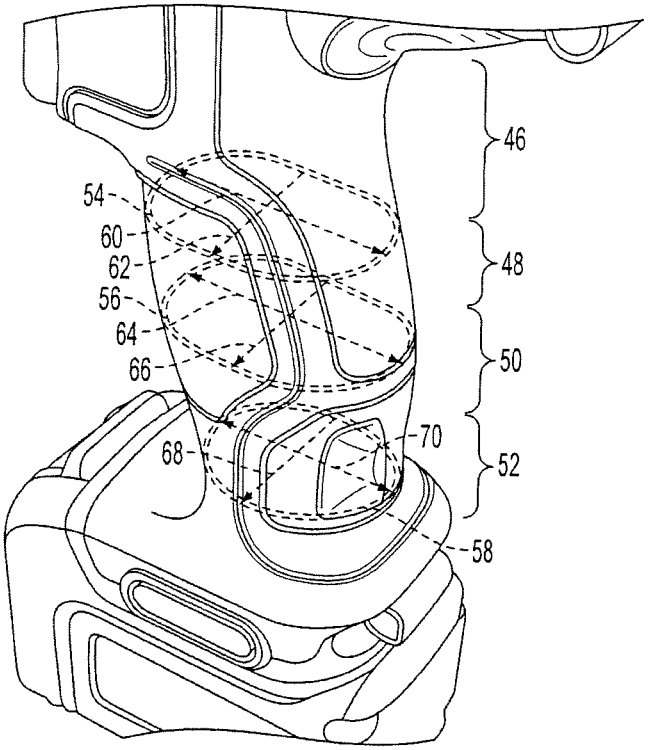
FIG. 3 is a perspective view of the handle of FIG. 1, partially in cross-section.

Referring to FIGS. 1 and 3, each of the second region 48, the third region 50, and the fourth region 52 includes a plurality of generally oval cross sections, each taken approximately parallel to the axis X-X. For sake of clarity, FIG. 3 shows a single exemplary oval cross-section in each of the second region 48, third region 50, and fourth region 52. However, it should be understood that each region has an infinite number of similar cross-sections. The second region 48 contains the generally oval cross-section 54 that has a major axis 60 and a minor axis 62, where the minor axis 62 is the shortest of any other minor axis of any other oval cross-section in the second, third, and fourth regions. For example, the oval cross-section 54 has a minor axis 62 that is approximately 31.5 mm in length. In addition, the major axis 60 is shorter than all of the other major axes in the third region 50, but longer than all of the other major axes in the fourth region 52, for example approximately 42 mm in length. The third region 50 contains the oval cross-section 56 with a major axis 64 and a minor axis 66, where the major axis 64 is the longest of any other major axis in the second, third, or fourth regions, e.g., approximately 44 mm. In addition, the minor axis 66 is longer than all of the other minor axes in the second region 48 and shorter than all of the other minor axes in the fourth region 52, e.g., approximately 32.5 mm. The fourth region has an oval cross-section 58 with a major axis 70 and a minor axis 68, where the minor axis 68 is the longest of any other minor axis in the second, third, or fourth regions, e.g., approximately 34 mm. The major axis 70 is the shortest of any other major axis in the second, third, or fourth regions, e.g., approximately 36 mm.

Figure 2:
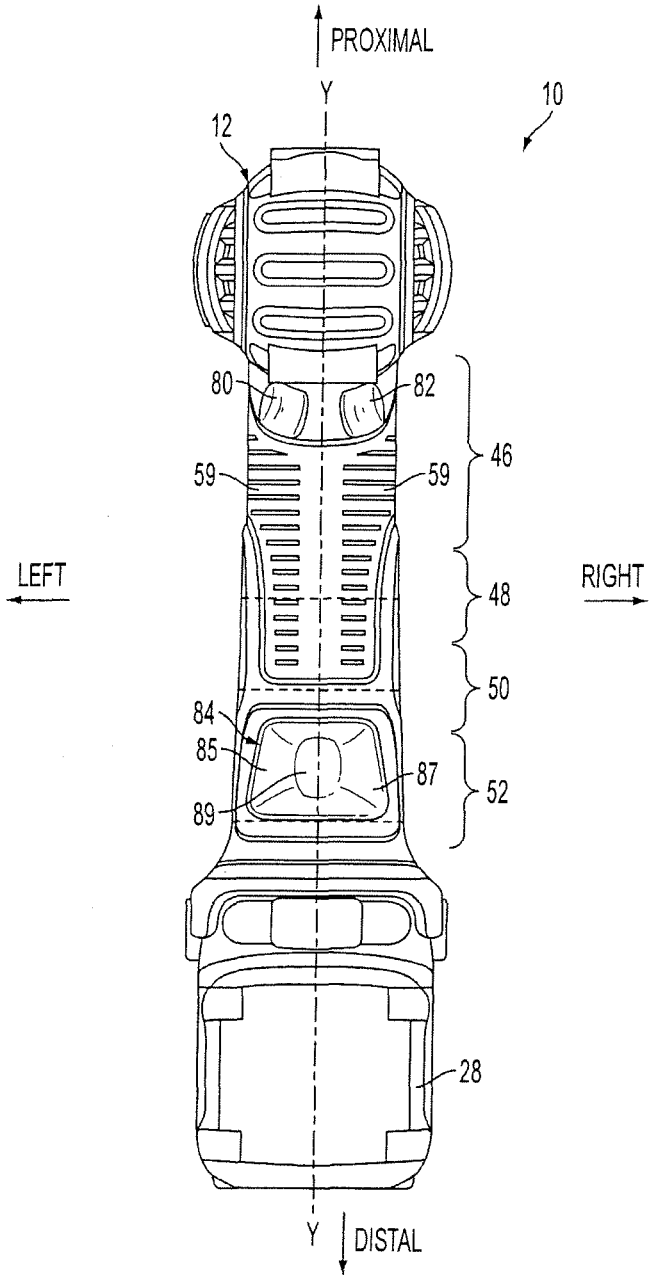
FIG. 2 is a back view of the power tool of FIG. 1.

When the handle 40 is viewed from the rear, as shown in FIG. 2, the minor axes of the handle cross-sections gradually increase in length from the first region 46 to the fourth region 52, such that the handle tapers outwardly in a distal direction. When the handle 40 is viewed from the side, as shown in FIG. 1, the major axes of the handle cross-section increase in length moving distally from the second region 48 into the third region 50, reaching a maximum at oval cross-section 56 in the third region 50. The major axes then decrease in length moving distally from the oval cross-section 56 through the remainder of the third region 50 and through the fourth region 52 reaching a minimum in the fourth region 52 near the junction between the fourth region 52 and the distal end portion 44 of the handle 40.

In addition, as illustrated in FIG. 1, the handle 40 is configured so that the rearward-most point 61 on the second, third, and fourth regions of the handle 40 is located at the distal end of the fourth region 52, such that point 61 is equal to or more rearward than any other point more proximal on the second, third, or fourth regions of the handle 40. The rearward edge 65 of the second, third, and fourth portions of the handle 40 tends to have a curvature approximately like a top-half of a parenthesis. The front-most point 63 on the second, third, and fourth portions of the handle 40 is located at the proximal end of the second region 48, such that point 63 is equal to or more forward than any other point more distal on the second, third, or fourth regions of the handle 40. The frontward edge 67 of the second, third, and fourth portions of the handle 40 tends to have a shape approximately like a bottom half of a parenthesis, with a slight curvature back in the frontward direction at the bottom of the parenthesis.

Referring to FIGS. 1 and 6, the first region 46 includes a semi-circular shaped thumb-forefinger recess 69 having a curvature configured to receive the web 112 between the user's thumb and forefinger. The thumb-forefinger recess 69 has a radius R and a center C. An imaginary line L-L drawn between the center C and a center-point of the trigger 30 is substantially parallel to the tool bit holder axis X-X. The trigger travels along the line L-L such that the trigger travels substantially parallel to the tool holder axis X-X.

Figure 5:
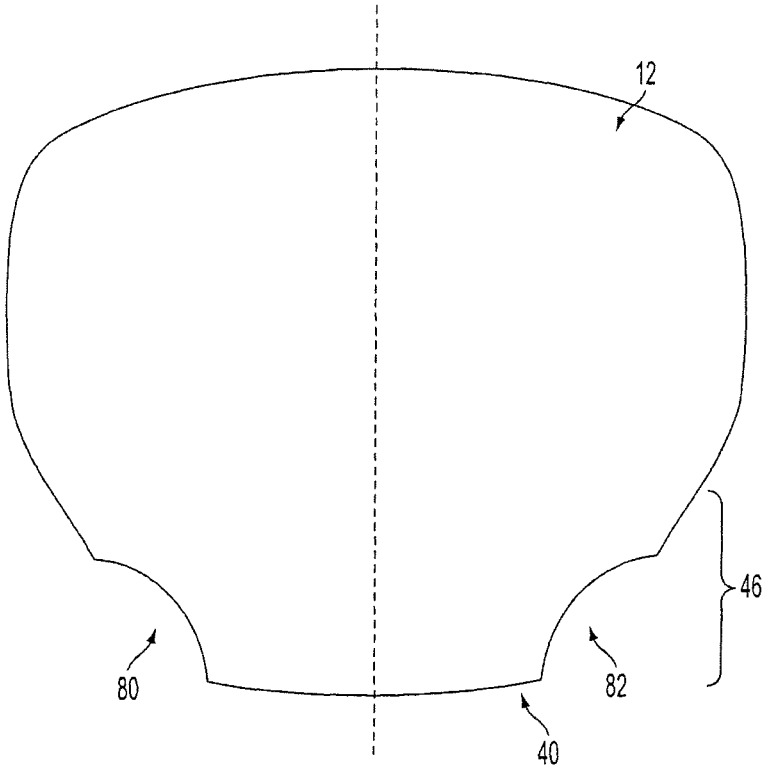
FIG. 5 is a cross-sectional view of the power tool of FIG. 1 taken along line 5-5.

Referring to FIGS. 1, 2, and 6, the first region 46 also includes a pair of thumb-knuckle resting portions 80 and 82 on opposite sides of the handle 40. Each thumb-knuckle resting portion 80 and 82 extends in a generally rearward direction from the front-most point of the portion 80, 82 toward the rear end of the handle to blend with the housing 12. Each of the thumb-knuckle resting portion 80, 82 are configured to receive the thumb knuckle 117 of the user at the junction between proximal phalange 120 and the metacarpal 119 of the thumb 102. There is a thumb-knuckle recess 80, 82 on each side of the tool in order to accommodate both right and left handed users. Referring also to FIG. 5, in cross-section B-B (taken through the housing and the handle generally perpendicular to the tool holder axis X-X), each thumb-knuckle recess 80, 82 has a curvature that is generally inverse to the curvature of the remainder of the housing and handle. In other embodiments, the thumb-knuckle recess may have a flat profile or may have a curvature in the same direction of the housing and handle, but with a different dimension.

Figure 4:
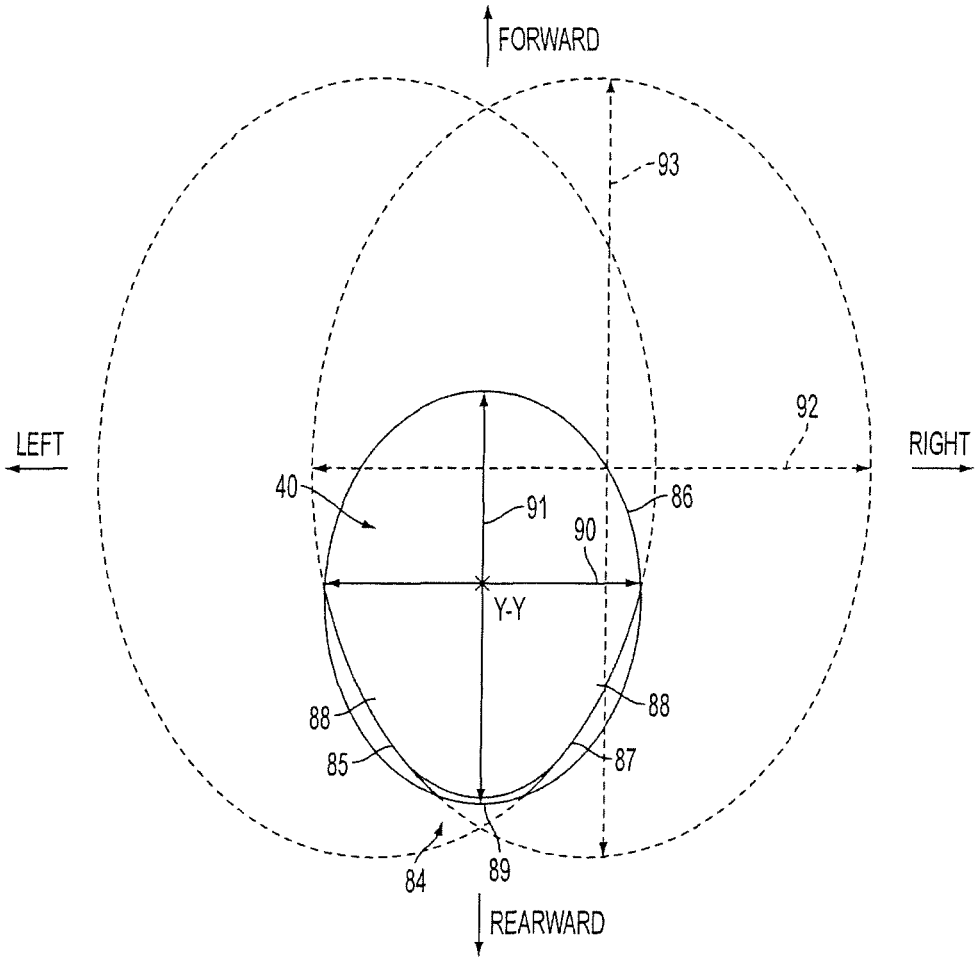
FIG. 4 is a cross-sectional view of the power tool of FIG. 1 taken along line 4-4.

Referring to FIGS. 1, 2, and 6, the fourth region 52 of the handle 40 includes a palm grip relief 84, which is configured to receive the hypothenar eminence 116 of the user's palm. The palm grip relief 84 wraps around the rear of the handle and is symmetrical on both sides of the handle. The palm grip relief includes a left portion 85 and a right portion 87 on opposite sides of the handle 40 that meet at a central portion 89. When viewed from the side view (i.e., as shown in FIG. 1), the left portion 85 and right portion 87 each have a generally C-shape. Referring also to FIG. 4, in cross-section A-A (taken through the handle at the palm-grip relief generally parallel to the tool bit holder axis X-X), the handle 40 has a first generally elliptical shape 86 with the left portion 85 and the right portion 87 of the palm grip relief 84 each having a second generally elliptical shape 88 that is different from the first generally elliptical shape 86. For example, the first generally elliptical shape 86 has a major axis 91 and a minor axis 90, each centered on the handle axis Y-Y, while each second elliptical shape 88 has a major axis 93 that is centered forward of the handle axis Y-Y and a minor axis 92 that is centered to the left or the right of the handle axis Y-Y. In addition, the major axis 93 and minor axis 92 of each second elliptical shape 88 are larger than the major axis 91 and minor axis 90, respectively, of the first elliptical shape 86. Further, each second elliptical shape 88 has a curvature that is different from that of the first elliptical shape 86. In other embodiments, the major and/or minor axes of the second elliptical shapes may be centered in different locations or be smaller than or equal to the major and/or minor axes of the first elliptical shape and/or the second elliptical shape may have a different curvature than that shown. In yet further embodiments, the shape of the left portion 85 and right portion 87 of the palm grip relief 84 may not be elliptical, but instead be a flattened portion, or may have a curvature that us inverse to that of the handle 40.

Referring to FIGS. 1 and 6, the handle 40 also includes a pair of finger support ridges 94 that run along each side of the handle. Each finger support ridge 94 has a first section 95 that starts adjacent to the trigger in the first region 46 and extends in a rearward direction substantially parallel to the axis X-X. The ridge has a second section 96 that extends from the first section 95 and continues through the second and third regions substantially parallel to the handle axis. The ridge also has a third section 97 then continues through the fourth section in a generally curved section that extends forward and then rearward as it extends distally. The third section 97 has a generally C-shaped contour that corresponds to the generally C-shaped contour of the palm grip relief 84. The finger support ridge 94 is configured to abut against the fingertips of the user when the user is gripping the handle, in order to better grip the handle 40. Gripping surfaces 57 are disposed on either side of the finger support ridge 94 and are contoured like the finger support ridge 94. Gripping surfaces 57 are contoured to receive the user's fingertips on one side of the handle 40, while receiving the fleshy pads 120, 122, 124, and 126 on the other side of the handle 40.

Figure 10:
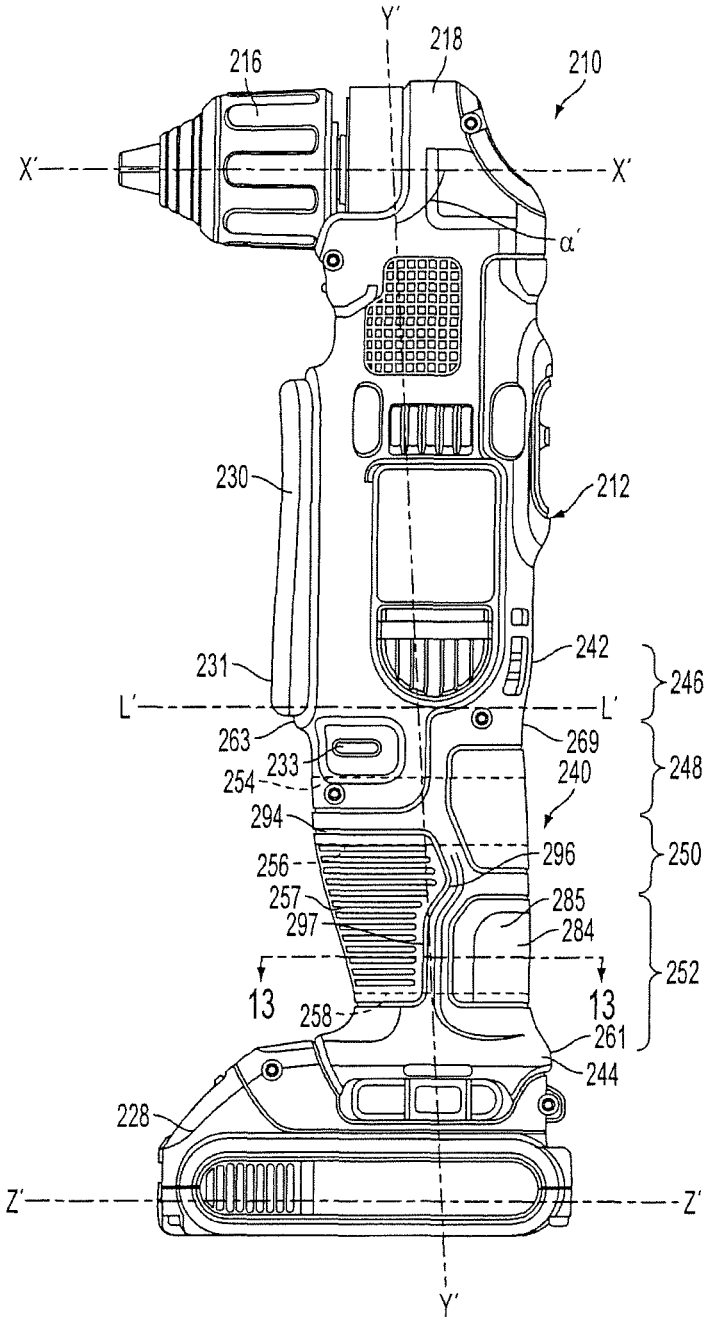
FIG. 10 is a side view of a second embodiment of a power tool having an ergonomic handle.

Referring to FIGS. 10 and 14, a second embodiment of a power tool 210 has a housing 212 that contains a source of motion, in the form of a rotary motor 214. Coupled to a top portion 218 of the housing is a working end of the tool in the form of a tool holder 216 for retaining a tool bit (e.g., a drill bit or screw driving bit, not shown) defining a tool holder axis X'-X'. As shown, the working end is a chuck. The working end could also be another element, such as a hex but retention mechanism (e.g., the one described above with respect to the first embodiment). The motor 214 drives the tool holder 216 in a rotary motion via a transmission 220 that includes a two-stage planetary gear set 222, a right angle gear set 224, and an output spindle 226 to which the tool holder is connected. The motor 214 is powered by a power source in the form of a battery 228, which is coupled to the motor 214 via a trigger 230 that actuates a switch 232 for selectively activating the motor 214. The battery 228 defines an axis Z'-Z' that is substantially parallel to the tool bit holder axis X'-X'. As shown in the drawings, the power tool is a battery powered cordless right-angle drill. However, it should be understood that the tool may be any type of corded, cordless, pneumatic, or combustion powered right angle tool, such as a hammer drill, an impact driver, a screwdriver, or a grinder.

The power tool 210 also includes a handle 240 with a proximal end portion 242 coupled to the housing 212 and a distal end portion 244 coupled to the battery 228. The handle 240 extends generally along a handle axis Y'-Y' that is at an angle $\alpha'$ to the tool bit holder axis X'-X'. For example, the angle $\alpha'$ may be approximately 80-90 degrees, such that the distal end portion is at or approximately generally rearward of the proximal end portion. It should be understood that this angle can be varied among a wide range of angles.

Figure 14B:
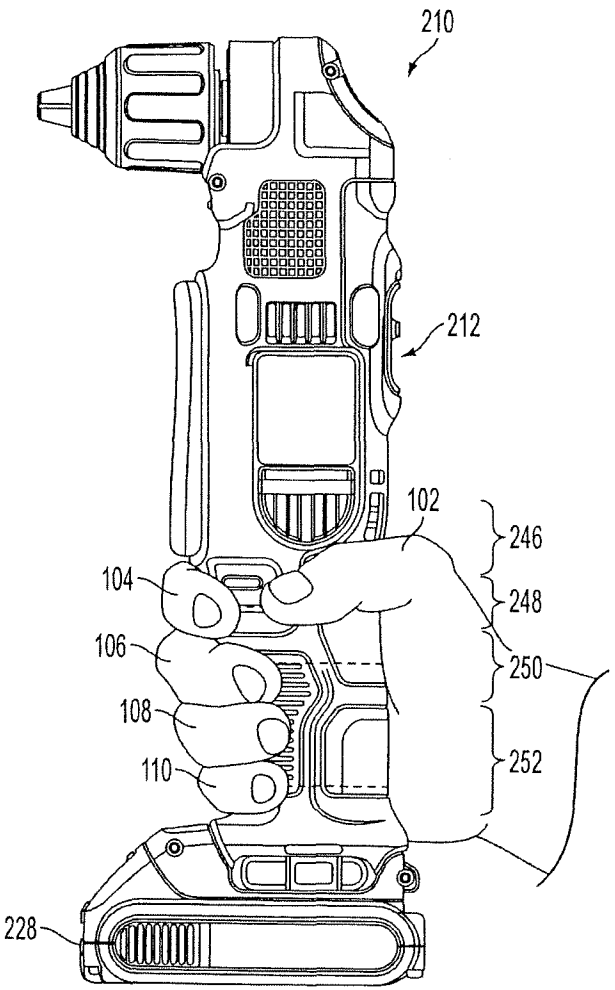
FIG. 14B is a side view of the power tool of FIG. 10 being held in the hand of a user when the trigger is being activated.
Figure 14A:
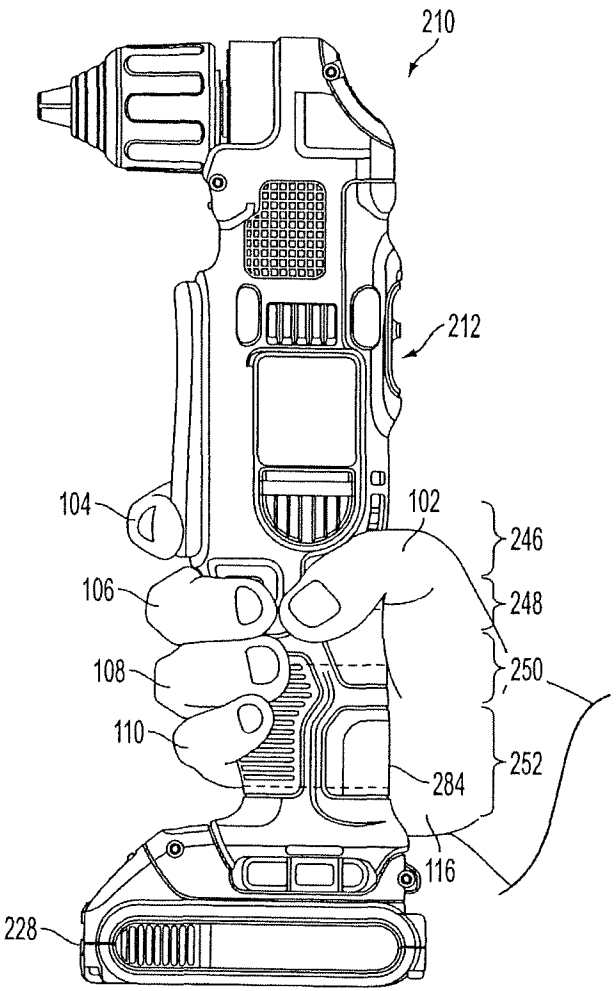
FIG. 14A is a side view of the power tool of FIG. 10 being held in the hand of a user when the trigger is not be activated.
Figure 15:
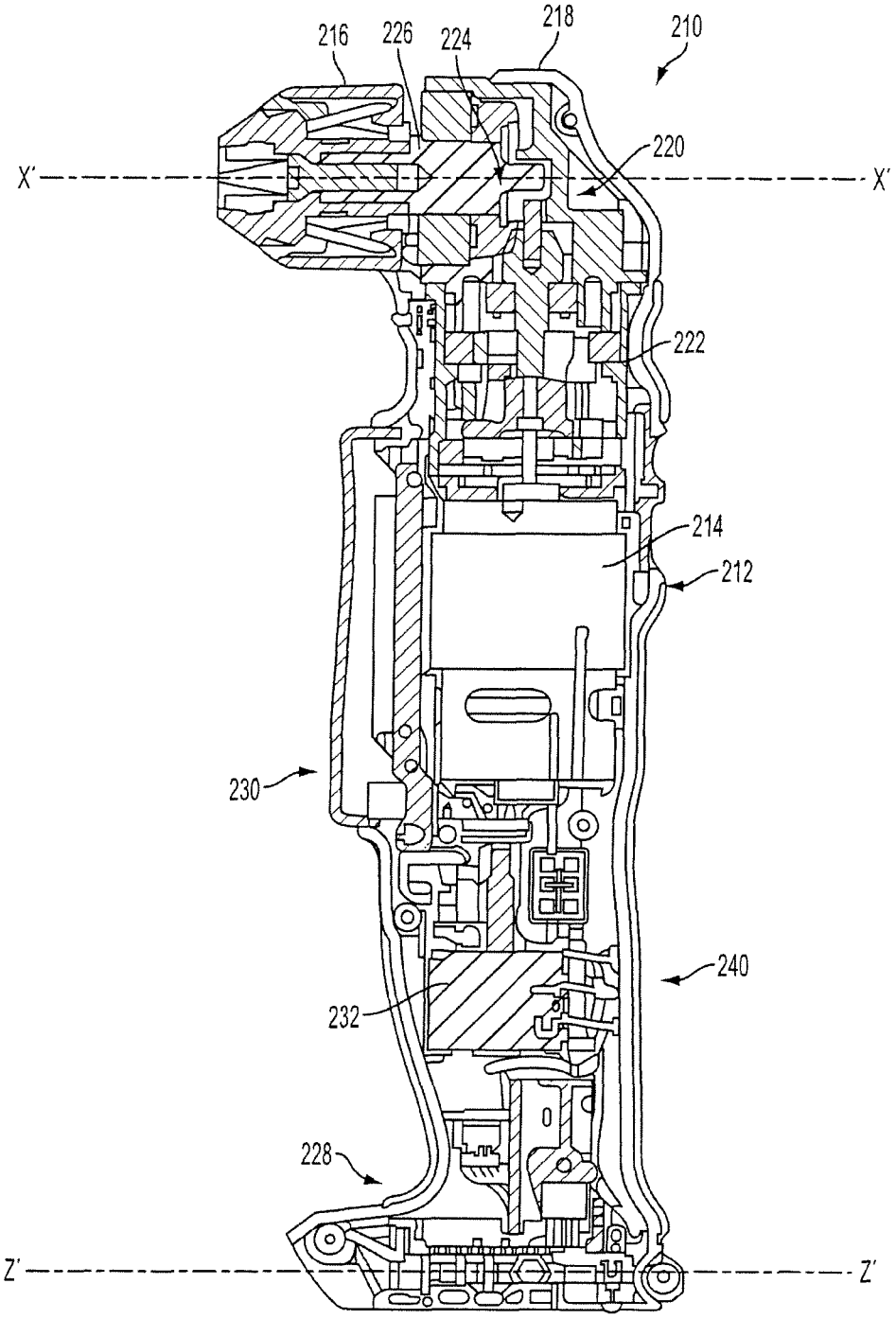
FIG. 15 is a cross-sectional side view of the power tool of FIG. 10, showing interior components of the tool.

The handle 240 is ergonomically designed to be contoured to a user's hand, the anatomy of which is shown and described above in FIGS. 7 and 8. Referring to FIGS. 10, 14A, and 14B from the proximal end portion 242 to the distal end portion 244, the handle 240 defines a first region 246, a second region 248, third region 250, and fourth region 252, which is adapted to receive the user's hand as follows. The first region 246 includes a bottom portion 231 of the trigger 230. The first region is adapted to receive the user's thumb 102 and forefinger 104 when the forefinger 104 is actuating the trigger (FIG. 14A), and is adapted to receive only the user's thumb 102, and no fingers, when the trigger is not being actuated (FIG. 14B). The second region 248 contains a forward-reverse switch 233 for reversing the direction of the motor. The second region 248 is adapted to receive the user's middle finger 106 when the trigger is being actuated (FIG. 14A), and to receive the user's forefinger 104 when the trigger is not being actuated (FIG. 14B), so that the forefinger can actuate the forward-reverse switch 233. The third region 250 is adapted to receive the user's ring finger 108 when the trigger is being actuated (FIG. 14A), and is adapted to receive the user's middle finger 106 when the trigger is not being actuated (FIG. 14B). The fourth region 252 is adapted to receive the user's pinky finger 110 when the trigger is being actuated (FIG. 14A), and is adapted to receive the user's ring finger 108 and pinky finger 110 when the trigger is not being actuated (FIG. 14B). It should be understood that the positions of the user's fingers on the first through fourth regions are rough approximations and may vary from user to user. In one embodiment, the overall length of the second, third, and fourth regions is at least approximately 64 mm, as it has been found that at least this length is needed to receive the hands of a majority of users.

Figure 12:
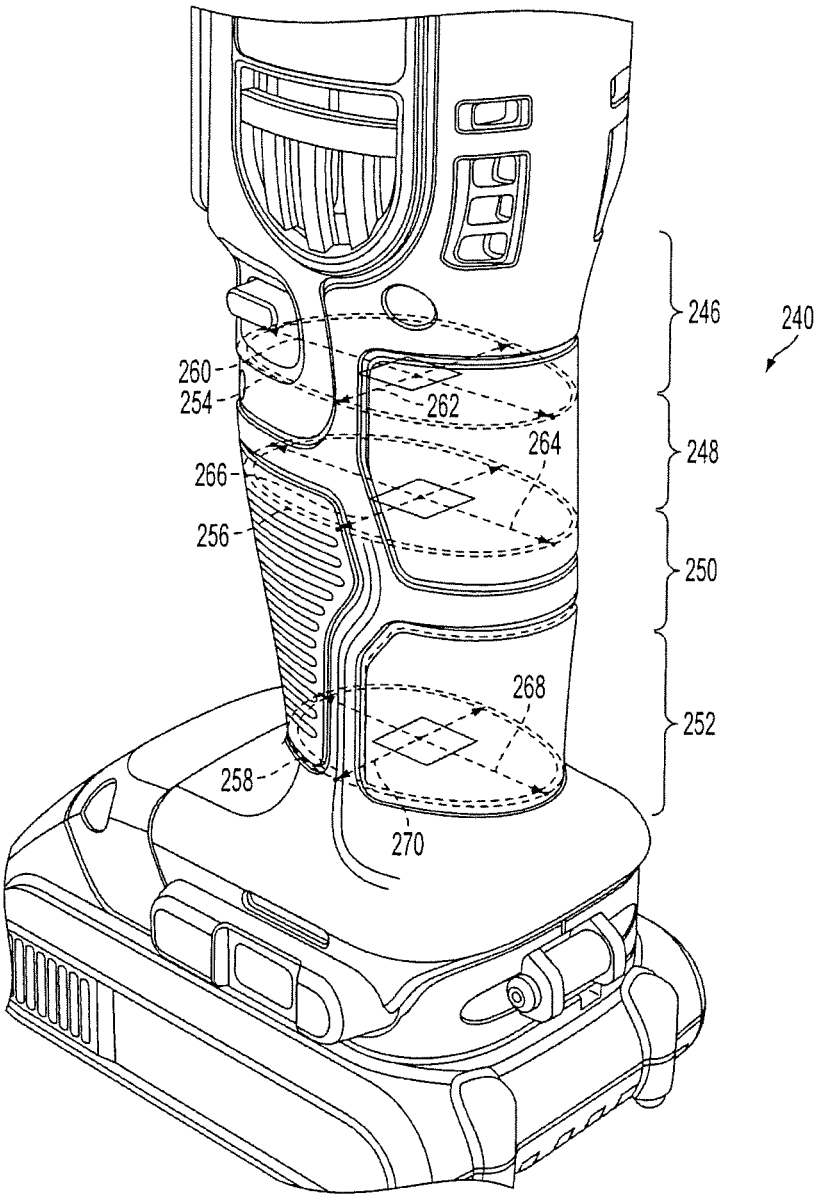
FIG. 12 is a perspective view of the handle of FIG. 10, partially in cross-section.

Referring to FIGS. 10 and 12, each of the second region 248, the third region 250, and the fourth region 252 includes a plurality of generally oval cross sections, each taken approximately parallel to the axis X'-X'. For sake of clarity, FIG. 12 shows a single exemplary oval cross-section in each of the second region 248, third region 250, and fourth region 252. However, it should be understood that each region has an infinite number of similar cross-sections. The second region 248 contains the generally oval cross-section 254 that has a major axis 260 and a minor axis 262, where the minor axis 262 is the shortest of any other minor axis of any other oval cross-section in the second, third, and fourth regions. For example, the oval cross-section 254 has a minor axis 262 that is approximately 35.4 mm in length. In addition, the major axis 260 is shorter than all of the other major axes in the third region 250, but longer than all of the other major axes in the fourth region 252, for example approximately 58 mm in length. The third region 250 contains the oval cross-section 256 with a major axis 264 and a minor axis 266, where the major axis 264 is the longest of any other major axis in the second, third, or fourth regions, e.g., approximately 59 mm. In addition, the minor axis 266 is longer than all of the other minor axes in the second region 248 and shorter than all of the other minor axes in the fourth region 52, e.g., approximately 35.8 mm. The fourth region has an oval cross-section 258 with a major axis 268 and a minor axis 270, where the minor axis 270 is the longest of any other minor axis in the second, third, or fourth regions, e.g., approximately 38 mm. The major axis 268 is the shortest of any other major axis in the second, third, or fourth regions, e.g., approximately 48 mm.

Figure 11:
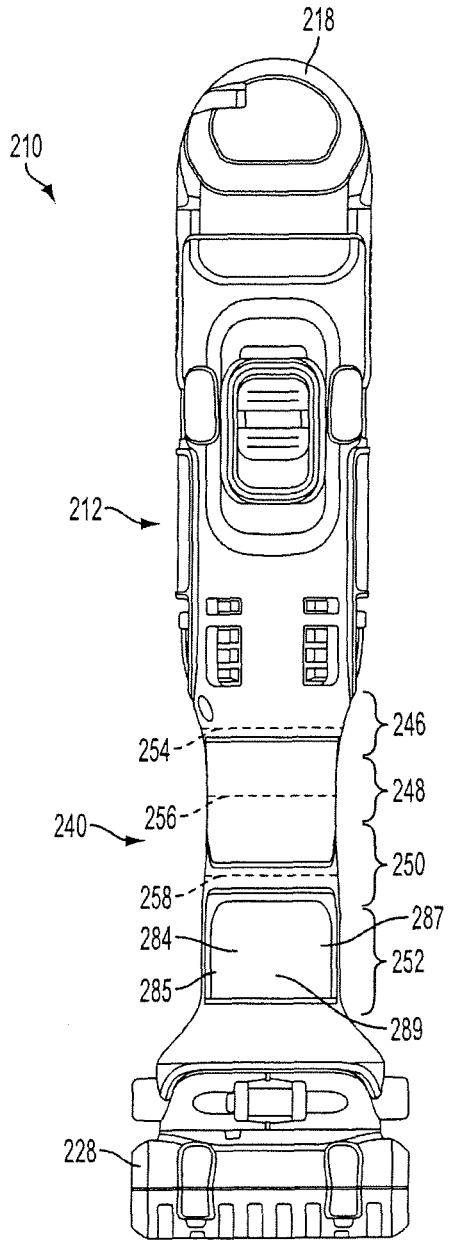
FIG. 11 is a back view of the power tool of FIG. 10.

When the handle 240 is viewed from the rear, as shown in FIG. 11, the minor axes of the handle cross-sections gradually increase in length from the second region 248 to the fourth region 252, such that the handle tapers outwardly in a distal direction. When the handle 40 is viewed from the side, as shown in FIG. 10, the major axes of the handle cross-section increase in length moving distally from the second region 248 into the third region 250, reaching a maximum at oval cross-section 256 in the third region 250. The major axes then decrease in length moving distally from the oval cross-section 256 through the remainder of the third region 250 and through the fourth region 252 reaching a minimum in the fourth region 252 near the junction between the fourth region 252 and the distal end portion 244 of the handle 240.

In addition, as illustrated in FIG. 10, the handle 240 is configured so that the rearward-most point 261 on the second, third, and fourth regions of the handle 40 is located at the distal end of the fourth region 252, such that point 261 is equal to or more rearward than any other point more proximal on the second, third, or fourth regions of the handle 240. The front-most point 263 on the second, third, and fourth portions of the handle 240 is located at the proximal end of the second region 248, such that point 263 is equal to or more forward than any other point more distal on the second, third, or fourth regions of the handle 240. The frontward edge 267 of the second, third, and fourth portions of the handle 40 tends to have a shape approximately like a bottom half of a parenthesis, with a slight curvature back in the frontward direction at the bottom of the parenthesis.

Referring to FIGS. 10 and 14A-14B, the first region 246 includes a semi-circular shaped thumb-forefinger recess 269 having a curvature configured to receive the web 112 between the user's thumb and forefinger. The trigger 231 travels along an imaginary line L'-L' that is substantially parallel to the tool holder axis X'-X' such that the forefinger 104 is pulled toward the thumb-forefinger recess 269.

Figure 13:
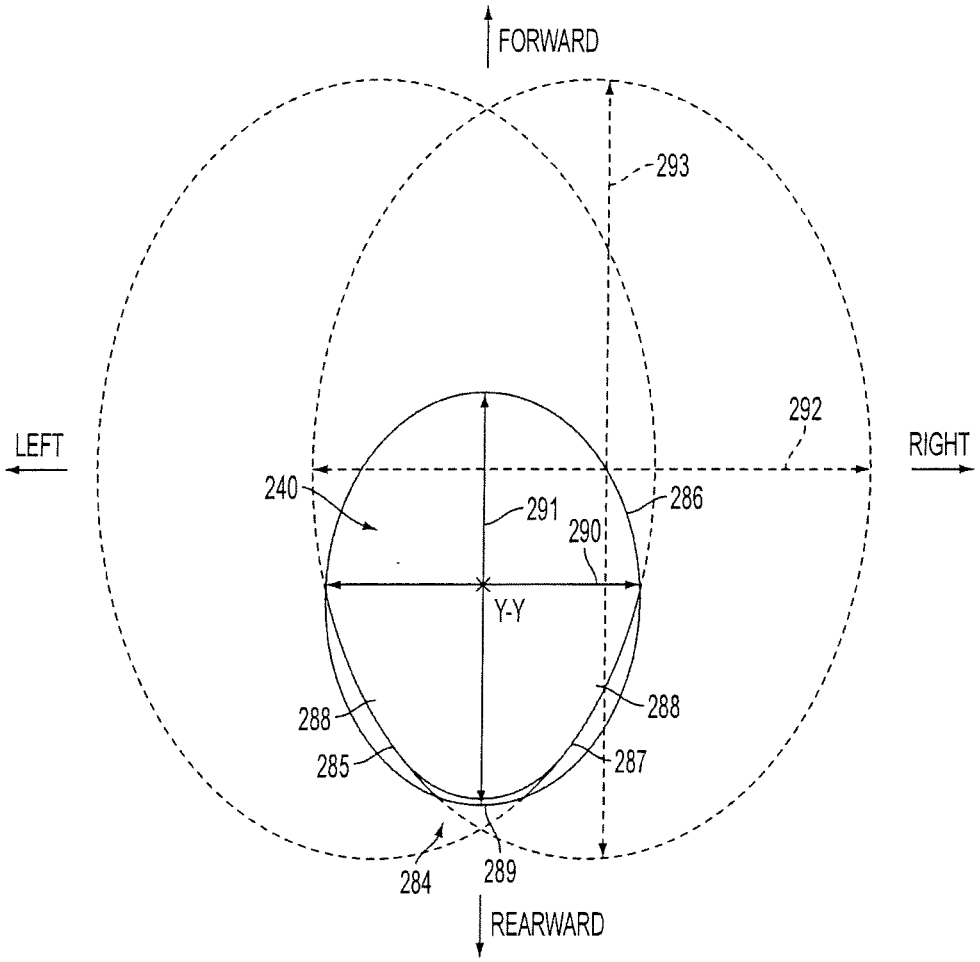
FIG. 13 is a cross-sectional view of the power tool of FIG. 10 taken along line 13-13.

Referring to FIGS. 10, 11, and 14A-14B, the fourth region 252 of the handle 240 includes a palm grip relief 284, which is configured to receive the hypothenar eminence 116 of the user's palm. The palm grip relief 284 wraps around the rear of the handle and is symmetrical on both sides of the handle. The palm grip relief includes a left portion 285 and a right portion 287 on opposite sides of the handle 240 that meet at a central portion 289. When viewed from the side view (i.e., as shown in FIG. 10), the left portion 285 and right portion 287 each have a generally C-shape. Referring also to FIG. 13, in cross-section C-C (taken through the handle at the palm-grip relief generally parallel to the tool bit holder axis X-X), the handle 240 has a first generally elliptical shape 286 with the left portion 285 and the right portion 287 of the palm grip relief 284 each having a second generally elliptical shape 288 that is different from the first generally elliptical shape 286. For example, the first generally elliptical shape 286 has a major axis 291 and a minor axis 290, each centered on the handle axis Y-Y, while each second elliptical shape 288 has a major axis 293 that is centered forward of the handle axis Y-Y and a minor axis 292 that is centered to the left or the right of the handle axis Y-Y. In addition, the major axis 293 and minor axis 292 of each second elliptical shape 288 are larger than the major axis 291 and minor axis 290, respectively, of the first elliptical shape 286. Further, each second elliptical shape 288 has a curvature that is different from that of the first elliptical shape 286. In other embodiments, the major and/or minor axes of the second elliptical shapes may be centered in different locations or be smaller than or equal to the major and/or minor axes of the first elliptical shape and/or the second elliptical shape may have a different curvature than that shown. In yet further embodiments, the shape of the left portion 285 and right portion 287 of the palm grip relief 284 may not be elliptical, but instead be a flattened portion, or may have a curvature that us inverse to that of the handle 240.

Referring to FIGS. 10 and 14A-14B, the handle 240 also includes a pair of finger support ridges 294 that run along each side of the handle. Each finger support ridge 294 has a first section 295 that starts adjacent to the junction of the second region 248 and the third region 250 extends in a rearward direction substantially parallel to the axis X'-X'. The ridge has a second section 296 that extends from the first section 295 and continues through the third region 250 at an angle that is more acute than the handle axis Y'-Y'. The ridge also has a third section 297 then continues through the fourth section and that extends forward and then distally approximately perpendicular to the axis X'-X'. The finger support ridge 294 is configured to abut against the fingertips of the user when the user is gripping the handle, in order to better grip the handle 240. Gripping surfaces 257 are disposed on either side of the finger support ridge 294 and are contoured like the finger support ridge 294. Gripping surfaces 257 are contoured to receive the user's fingertips on one side of the handle 240, while receiving the fleshy pads 120, 122, 124, and 126 on the user's palm other side of the handle 40.

A biomechanical evaluation was performed on a prototype of the first embodiment, power tool 10 and handle 40 described above, in accordance with internal protocols and referencing data tables set forth in Stephen Pheasant, *Bodyspace: Anthropometry, Ergonomics and the Design of the Work*, Second Edition (Taylor and Francis 2007) and Thomas M. Greiner; "Hand Anthropometry of US Army Personal," Army Natick Research Development and Engineering Center, Technical Report Natick/TR-92/011, December 1991. The prototype was substantially as described above except for lacking a thumb-knuckle resting portion 80, a palm grip relief 84, and a finger support ridge 94. The prototype was compared with a Bosch PS-20 drill, a Makita DF030D drill, and a Hitachi B10DL drill (collectively the "alternative tools").

In the biomechanical evaluation, human test subjects used the prototype and the alternative tools in work cycles designed to simulate using the tools to repeatedly insert Phillips head screws into wood. During each test cycle, the test subjects would use the tools to apply an axial load in the direction of the simulated application of approximately 25-30 pounds of force for 3 seconds, followed by 7 seconds of rest. This cycle would be repeated for durations of 2 minutes, 4 minutes, 6 minutes, and 10 minutes total, or until the test subjects became too fatigued or in too much discomfort to continue. Each test subject used each of the tools for these tests in a non-rotating order.

All of the test subjects ranked the prototype tool as being best or second best in the overall ergonomic comfort of the tool, with 75% of the test subjects ranking the prototype as the best among the tested tools. In addition, several test subjects identified problems with discomfort in the thumb joint area and the hypothenar eminence. This led to the design of the thumb knuckle resting portion 80 and the palm grip relief 84, respectively.

The foregoing description relates to only several possible embodiments and is not limiting. Numerous modifications can be made within the scope of the invention(s) disclosed above.

What is claimed is:

1. A handle for a power tool that includes a housing having a working region defining a working axis with a forward direction extending toward the working region and a rearward direction extending away from the working region, the handle comprising:

a proximal end portion coupled to the housing;

a top region adjacent to and distal of the proximal end portion, and having a generally oval cross section with a major axis and a minor axis;

a middle region adjacent to and distal of the top region, and having a generally oval cross section with a major axis and a minor axis;

a bottom region adjacent to and distal of the middle region, and having a generally oval cross section with a major axis and a minor axis; and a distal end portion adjacent to and distal of the bottom region, wherein the cross section having the longest major axis is in the middle region, and the cross section having the longest minor axis is in the bottom region.

2. The handle of claim 1, wherein the cross section having the shortest major axis is in the bottom region.

3. The handle of claim 2, wherein the cross section having the shortest minor axis is in the top region.

4. The handle of claim 1, wherein the major axes of the top region, the middle region, and the bottom region together define a rearward edge having a generally convex curvature with a rearward-most point of the rearward edge located in the bottom region.

5. The handle of claim 1, wherein the major axes of the top region, the middle region, and the bottom region together define a forward edge having a portion with a generally convex curvature and having a forward-most point of the forward edge located in the top region.

6. The handle of claim 1, wherein the minor axes of top region, the middle region, and the bottom region together define a left edge and a right edge, wherein the left edge and the right edge taper away from each other from the top region to the bottom region.

7. The handle of claim 1, wherein a rearward portion of the proximal end portion includes a recess with a generally concave curvature configured to receive a knuckle of a user's thumb.

8. The handle of claim 1, wherein a rearward portion of the bottom region includes a relief configured to receive a palm of a user's hand.

9. The handle of claim 1, wherein the at least one of the top, middle, and bottom regions includes a support ridge that runs along a side of the handle.

10. A power tool comprising:

a housing;

a working region coupled to the housing and defining a working axis with a forward direction extending from the housing toward the working region and a rearward direction extending from the housing away from the working region;

a handle including:

a proximal end portion coupled to the housing;

a top region adjacent to and distal of the proximal end portion, and having a generally oval cross section with a major axis and a minor axis;

a middle region adjacent to and distal of the top region, and having a generally oval cross section with a major axis and a minor axis;

a bottom region adjacent to and distal of the middle region, and having a generally oval cross section with a major axis and a minor axis; and a distal end portion adjacent to and distal of the bottom region, wherein the cross section having the shortest major axis is in the bottom region, and the cross section having the longest minor axis is in the bottom region.

11. The power tool of claim 10, wherein the cross section having the longest major axis is in the middle region.

12. The power tool of claim 11, wherein the cross section having the shortest minor axis is in the top region.

13. The power tool of claim 10, wherein the major axes of the top region, the middle region, and the bottom region together define a rearward edge having a generally convex curvature with a rearward-most point of the rearward edge located in the bottom region.

14. The power tool of claim 10, wherein the major axes of the top region, the middle region, and the bottom region together define a forward edge having at least a portion with a generally convex curvature with a forward-most point of the forward edge located in the top region.

15. The power tool of claim 10, wherein the minor axes of top region, the middle region, and the bottom region together define a left edge and a right edge, wherein the left edge and the right edge taper away from each other from the top region to the bottom region.

16. The power tool of claim 10, wherein the handle defines a handle axis that is substantially transverse to the working axis.

17. A handle for a power tool that includes a housing having a working region defining a working axis with a forward direction extending toward the working region and a rearward direction extending away from the working region, the handle comprising:

a proximal end portion coupled to the housing;

a top region adjacent to and distal of the proximal end portion;

a middle region adjacent to and distal of the top region;

a bottom region adjacent to and distal of the middle region; and a distal end portion adjacent to and distal of the bottom region, wherein the top region, the middle region, and the bottom region together define a front edge of the handle and a rear edge of the handle, the front edge and the rear edge defining an outward bulge in the middle region, and wherein the top region, the middle region, and the bottom region together define a left edge of the handle and a right edge of the handle, the left and right edges tapering away from each other from the top region to the bottom region.

18. The handle of claim 17, wherein a distance between the front edge and the rear edge is greatest in the middle region.

19. The handle of claim 18, wherein a distance between the left edge and the right edge is greatest in the bottom region.

* * * * *